United States Patent [19]

Okamura

[11] Patent Number: 4,498,314

[45] Date of Patent: Feb. 12, 1985

[54] FINGERNAIL JEWELRY DEVICE

[76] Inventor: Diane H. Okamura, 20824 Chester St., Castro Valley, Calif. 94546

[21] Appl. No.: 517,795

[22] Filed: Jul. 27, 1983

[51] Int. Cl.[3] ..... A44C 25/00

[52] U.S. Cl. ..... 63/2

[58] Field of Search ..... 63/1, 2; 132/73

[56] References Cited

U.S. PATENT DOCUMENTS 1,238,046 8/1917 Nuss ..... 63/2

2,013,290 9/1935 Rohrbach ..... 63/2

FOREIGN PATENT DOCUMENTS 114900 11/1929 Austria ..... 132/73

*Primary Examiner*—F. Barry Shay

*Attorney, Agent, or Firm*—Robert R. Tipton

[57] ABSTRACT

A fingernail jewelry device utilizes a first arcuate support leg having a curvature approximating the curvature of a fingernail as defined by the line of intersection of the fingernail with a plane perpendicular to the longitudinal axis of the fingernail combined with a second longitudinal arcuate support leg connected at one end to one end of the first support leg and adapted to frictionally engage the underside of the fingernail. Decorative jewelry or objects are arranged to mount on the first elongated arcuate support leg for display on top of the fingernail. The longitudinal axis of each support leg is arranged to be perpendicular to the longitudinal axis of the fingernail when placed thereon.

6 Claims, 4 Drawing Figures

FINGERNAIL JEWELRY DEVICE

BACKGROUND OF THE PRIOR ART

This invention relates generally to jewelry and in particular to jewelry devices adapted to mount on the fingernail.

Jewelry devices of the prior art which were mounted on the fingertip were constructed in various configurations.

One device comprised various C-shaped bridge members extending along the fingertip with the ends of the "C" members pointing toward the fingerprint portion. The curved portions of the C-shaped members covered the fingernail and had mounted thereon various decorative objects.

Other fingernail jewelry devices comprised a pair of curved members on which were mounted various gem stones or decorative objects. The devices were adapted to fit onto the tip of the fingernail in the manner of an extension to the fingernail tip. Other fingernail ornament devices also were configured to extend the tip of the fingernail and be held in place thereof through the use of a clip which engaged a small hole cut into the fingernail.

All of these prior art devices which attached directly to the fingernail were adapted to fit over the tip of the nail in the manner of a cap or an extension member which caused the fingers to appear exceptionally long.

SUMMARY OF THE INVENTION

The fingernail jewelry device of the present invention is not intended to act as a cap or slip over the tip end of the fingernail but rather is intended to be worn back of the fingernail tip leaving the tip of the fingernail exposed. The jewelry device of the present invention is also adapted to be placed on the fingernail by sliding it onto the fingernail from the side thereof.

The fingernail jewelry device of the present invention comprises, basically, a first elongated arcuate support leg having a curvature approximating the curvature of a fingernail as defined by the line of intersection of said fingernail with a plane perpendicular to the longitudinal axis of the fingernail. A second longitudinal support leg connected at one end to one end of the first support leg is adapted to frictionally engage the fingernail along the underside thereof. The first elongated arcuate support leg is also adapted to frictionally engage the fingernail but along the top thereof with the longitudinal axis of the first support leg disposed perpendicular to the longitudinal axis of the fingernail. Means are provided for mounting at least one decorative object on the first support leg.

It is, therefore, an object of the present invention to provide a fingernail jewelry device.

It is a further object of the present invention to provide a fingernail jewelry device which does not cover the tip of the fingernail.

It is yet another object of the present invention to provide a fingernail jewelry device which conforms generally to the arc of the fingernail as defined by the line of intersection of the fingernail with the plane perpendicular to the longitudinal axis of the fingernail.

It is yet a further object of the present invention to provide a fingernail jewelry device which can be fabricated out of a single elongated body member and deformed to define the first and second arcuate support legs with a connector section therebetween.

These and other objects of the present invention will become manifest upon careful study of the following detailed description when taken together with the drawings.

DESCRIPTION OF THE PREFERRED EMBODIMENT

Figure 1:
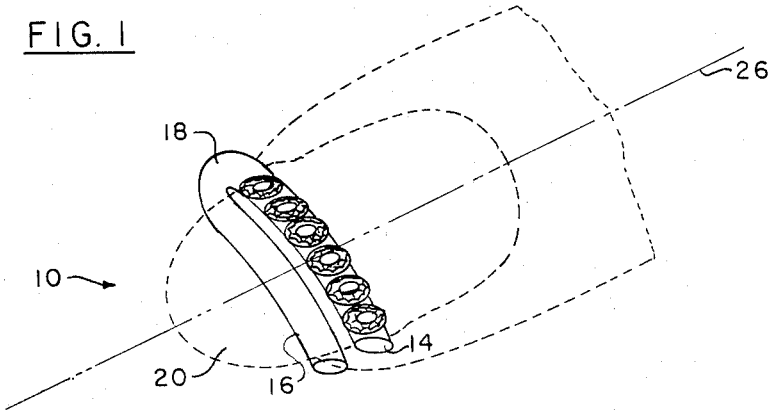
FIG. 1 is an isometric view of the fingernail jewelry device of the present invention as shown mounted on a fingernail.

With reference to FIG. 1 there is illustrated a front elevational view of the typical fingernail jewelry device 10 of the present invention comprising, basically, an elongated body member 12 deformed to define a first arcuate support leg 14 and a second arcuate support leg 16 connected by a connector section 18 which is adapted to maintain first support leg 14 and second support leg 16 spaced apart sufficiently to permit first and second legs 14 and 16, respectively, to frictionally engage fingernail 20.

In particular, first arcuate support leg 14 can be seen to frictionally engage fingernail 20 proximate the midpoint thereof, while second arcuate support legs 16 is adapted to frictionally engage fingernail 20 proximate the outer edges thereof.

Fingernail jewelry device 10 further comprises a plurality of decorative objects 22 which are adapted to mount on the top surface of first arcuate support leg 14.

Figure 2:
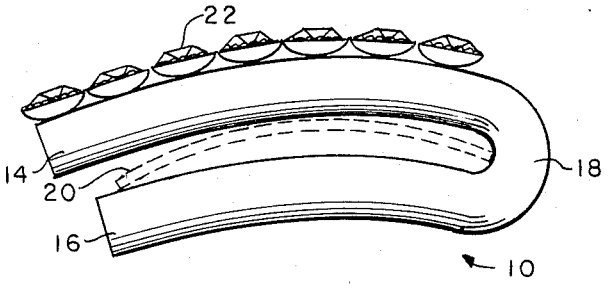
FIG. 2 is a front elevational view of the fingernail jewelry device of the present invention showing the shape of the device as mounted on a fingernail.

With reference to FIG. 2 there is illustrated a side elevational view of the fingernail jewelry device 10 of FIG. 1 further showing the plane of intersection "A" through fingernail 20 which is perpendicular to longitudinal axis 26 of fingernail 20. The line of intersection of fingernail 20 with plan "A" is shown in the dash lines of FIG. 1.

Figure 3:
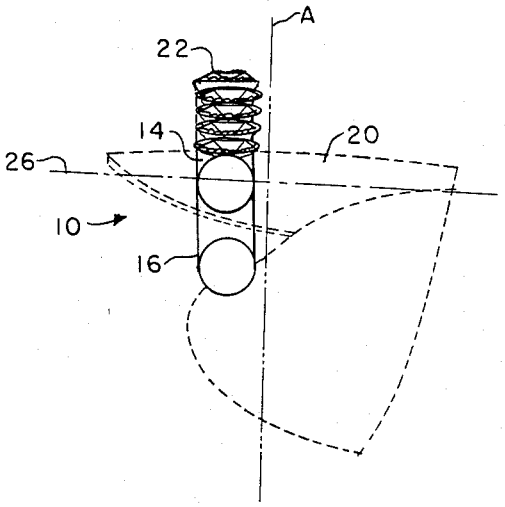
FIG. 3 is a side elevational view of the fingernail jewelry device of the present invention showing it mounted on a fingernail.

With reference to FIG. 3 there is illustrated an isometric view of the typical fingernail jewelry device 10 of the present invention as mounted on fingernail 20 showing its position generally perpendicular to longitudinal axis 26 of fingernail 20. Thus the tip of fingernail 20 is left exposed.

Figure 4:
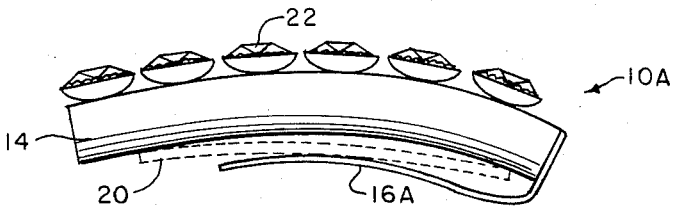
FIG. 4 is a front elevational view of a further embodiment of the fingernail jewelry device of the present invention showing the use of a resilient spring member as the second leg member.

With reference to FIG. 4 there is illustrated a further embodiment of the fingernail jewelry device 10 of the present invention (identified as fingernail jewelry device 10A in FIG. 4) in which the generally rigid second support leg 16 is replaced by a resilient spring member 16A having one end connected to one end of first support leg 14. It can be seen from FIG. 4 that first arcuate support leg 14 is adapted to frictionally engage fingernail 20 proximate the outer edges thereof with second support leg 16*a* adapted to frictionally engage the underside of fingernail 20 proximate the midpoint thereof.

Thus it can be seen that the fingernail jewelry device of the present invention can be slipped on and off the fingernail from the side of the fingernail and leave exposed in view the fingernail tip.

I claim:

1. A fingernail jewelry device comprising a first elongated arcuate support leg having a curvature approximating the curvature of a fingernail as defined by the line of intersection of said fingernail with a plane perpendicular to the longitudinal axis of said fingernail, a second elongated support leg connected at one end to one end of said first support leg, said second support leg adapted to frictionally engage said fingernail along the underside thereof, said first and second support leg combination defining an elongated arcuate U-shaped member, open at one end and adapted to be emplaced on said fingernail from one side of said fingernail in a direction perpendicular to the longitudinal axis of said fingernail said open end of said U-shaped member proximate a side of said fingernail, said first elongated arcuate support leg adapted to frictionally engage the top of said fingernail and having the longitudinal axis of said first support leg disposed perpendicular to the longitudinal axis of said fingernail, and means for mounting at least one decorative object on said first leg.

2. A fingernail jewelry device comprising a first elongated arcuate support leg having a curvature approximating the curvature of a fingernail as defined by the line of intersection of said fingernail with a plane perpendicular to the longitudinal axis of said fingernail, said first elongated support leg adapted to frictionally engage a portion of the top surface of said fingernail proximate the middle thereof, a second elongated support leg having one end connected to one end of said first support leg and having a curvature approximating the curvature of said first leg, said second leg spaced apart from said first leg, said first and second support leg combination defining an elongated arcuate U-shaped member, open at one end and adapted to be emplaced on said fingernail from one side of said fingernail in a direction perpendicular to the longitudinal axis of said fingernail, said open end of said U-shaped member proximate a side of said fingernail, said second elongated support leg adapted to frictionally engage the underside of said fingernail proximate the side portions thereof, and means for mounting at least one decorative object on said first support leg.

3. A fingernail jewelry device comprising a first elongated arcuate support leg having a curvature approximating the curvature of a fingernail as defined by the line of intersection of said fingernail with a plane perpendicular to the longitudinal axis of said fingernail, said first elongated support leg adapted to frictionally engage a portion of the top surface of said fingernail proximate the side portions thereof, a second elongated support leg having one end connected to one end of said first support leg and having a curvature greater than the curvature of said first support leg, said first and second support leg combination defining an elongated arcuate U-shaped member, open at one end and adapted to be emplaced on said fingernail from one side of said fingernail in a direction perpendicular to the longitudinal axis of said fingernail, said open end of said U-shaped member proximate a side of said fingernail, said second elongated support leg adapted to frictionally engage the underside of said fingernail proximate the middle portion thereof, and means for mounting at least one decorative object on said first support leg.

4. A fingernail jewelry device comprising an elongated body member deformed to define a first elongated arcuate support leg having a curvature approximating the curvature of a fingernail as defined by the line of intersection of said fingernail with a plane perpendicular to the longitudinal axis of said fingernail, a second elongated arcuate support leg having a curvature approximating the curvature of said first support leg, and a connector section connecting said first support leg to said second support leg and spacing said support legs apart sufficiently for said first support leg to frictionally engage a portion of the top of said fingernail and said second support leg to frictionally engage a portion of the underside of said fingernail, said first and second support leg combination defining an elongated arcuate U-shaped member, open at one end and adapted to be emplaced on said fingernail from one side of said fingernail in a direction perpendicular to the longitudinal axis of said fingernail, said open end of said U-shaped member proximate a side of said fingernail, and means for mounting at least one decorative object on said first support leg.

5. A fingernail jewelry device comprising a first elongated arcuate support leg having a generally circular cross section and having a curvature approximating the curvature of a fingernail as defined by the line of intersection of said fingernail with a plane perpendicular to the longitudinal axis of said fingernail, a second elongated support leg connected at one end to one end of said first support leg, said second support leg having a generally circular cross section and adapted to frictionally engage said fingernail along the underside thereof, said first and second support leg combination defining an elongated arcuate Y-shaped member, open at one end and adapted to be emplaced on said fingernail from one side of said fingernail in a direction perpendicular to the longitudinal axis of said fingernail and leave the tip of said fingernail uncovered, with said open end of said U-shaped member proximate a side of said fingernail, said first elongated arcuate support leg adapted to frictionally engage the top of said fingernail and having the longitudinal centerline of said first support leg disposed generally parallel to said plane, and means for mounting at least one decorative object on said first leg.

6. A fingernail jewelry device comprising a first elongated arcuate support leg having a generally circular cross section and having a curvature approximating the curvature of a fingernail as defined by the line of intersection of said fingernail with a plane perpendicular to the longitudinal axis of said fingernail, a second elongated support leg connected at one end to one end of said first support leg, said second support leg comprising a resilient leaf spring member biased against the underside of said first elongated support member and adapted to frictionally engage said fingernail along the underside thereof, said first and second support leg combination defining an elongated arcuate U-shaped member, open at one end when placed on a fingernail and adapted to be emplaced on said fingernail from one side of said fingernail in a direction perpendicular to the longitudinal axis of said fingernail and leave the tip of said fingernail uncovered, said open end of said U-shaped member disposed proximate a side of said fingernail, said first elongated arcuate support leg adapted to frictionally engage the top of said fingernail and having the longitudinal centerline of said first support leg disposed generally parallel to said plane, and means for mounting at least one decorative object on said first leg.

* * * * *